US009776777B2

(12) United States Patent
Gorbold

(10) Patent No.: US 9,776,777 B2
(45) Date of Patent: Oct. 3, 2017

(54) BOTTLE CAP

(71) Applicant: Helen of Troy Limited, St. Michael (BB)

(72) Inventor: Timothy Dryden Gorbold, Bend, OR (US)

(73) Assignee: Helen of Troy Limited, St. Michael (BB)

( * ) Notice: Subject to any disclaimer, the term of this patent is extended or adjusted under 35 U.S.C. 154(b) by 22 days.

(21) Appl. No.: 14/718,014

(22) Filed: May 20, 2015

(65) Prior Publication Data

US 2015/0336720 A1 Nov. 26, 2015

Related U.S. Application Data

(60) Provisional application No. 62/033,631, filed on Aug. 5, 2014, provisional application No. 62/001,024, filed on May 20, 2014.

(51) Int. Cl.
*B65D 47/32* (2006.01)
*A47G 19/22* (2006.01)
(Continued)

(52) U.S. Cl.
CPC ..... *B65D 47/32* (2013.01); *A47G 19/2266* (2013.01); *B65D 47/243* (2013.01); *B65D 51/242* (2013.01)

(58) Field of Classification Search
CPC .. A47G 19/2266; B65D 47/243; B65D 47/32; B65D 51/242
See application file for complete search history.

(56) References Cited

U.S. PATENT DOCUMENTS 2,135,052 A * 11/1938 Rose ..... A61H 35/04 604/24
2,969,168 A * 1/1961 Newby ..... B65D 47/247 222/498

(Continued)

OTHER PUBLICATIONS

Sep. 15, 2015, International Search Report from the U.S. Receiving Office, in PCT Application No. PCT/US2015/031845, which is an international application that shares the same priority as this U.S. application.

(Continued)

*Primary Examiner* — Frederick C Nicolas
*Assistant Examiner* — Bob Zadeh
(74) *Attorney, Agent, or Firm* — Kolisch Hartwell, P.C.

(57) ABSTRACT

An embodiment of a cap for a bottle may comprise a body and nozzle. The body may include an annular wall, an aperture configured to receive a nozzle, and a plug rigidly attached within the aperture. The nozzle may be movable between a retracted position in which fluid cannot pass between plug and nozzle, and an extended position in which fluid can pass between plug and nozzle. The nozzle may include an inner wall and an outer wall. The outer wall may have at least one longitudinal recess. The longitudinal recess may allow selective passage of air. The longitudinal recess may allow air to flow through the recess and into the bottle when the nozzle is in the extended position, and is contained within the aperture and is thus configured to prevent air from flowing through the recess and into the bottle when the nozzle is in the retracted position.

13 Claims, 12 Drawing Sheets

(51) Int. Cl.
*B65D 47/24* (2006.01)
*B65D 51/24* (2006.01)

(56) References Cited

U.S. PATENT DOCUMENTS 6,364,178 B1 * 4/2002 Paczonay ..... B67D 3/046 222/484
D553,914 S 10/2007 Wahl
D632,524 S 2/2011 Rosbach et al.
D633,338 S 3/2011 Rosbach et al.
D648,984 S 11/2011 Gullickson et al.
D652,256 S 1/2012 Eyal
D654,793 S 2/2012 Rosbach
D680,805 S 4/2013 Rosbach
D688,912 S 9/2013 Rosbach
D693,170 S 11/2013 Rosbach
D700,012 S 2/2014 Hurley et al.
D704,986 S 5/2014 Manies
2002/0074365 A1 * 6/2002 Young ..... B65D 47/243 222/484
2006/0071040 A1 * 4/2006 Young ..... B65D 47/0838 222/484
2011/0303630 A1 12/2011 Itzek et al.
2013/0214012 A1 * 8/2013 Pils ..... B65D 47/243 222/524
2015/0173539 A1 6/2015 Mason
2015/0201774 A1 7/2015 Sorensen et al.
2015/0336720 A1 * 11/2015 Gorbold ..... B65D 51/242 222/522

OTHER PUBLICATIONS

Sep. 15, 2015, Written Opinion from the U.S. Receiving Office, in PCT Application No. PCT/US2015/031845, which is an international application that shares the same priority as this U.S. application.
Nov. 22, 2016, International Preliminary Report on Patentability from the International Bureau of WIPO, in PCT Patent Application PCT/US2015/031845, which is the international application to this U.S. application.

* cited by examiner

BOTTLE CAP

CROSS-REFERENCE TO RELATED APPLICATIONS

This application claims priority from U.S. Provisional Patent Application Ser. Nos. 62/001,024, filed May 20, 2014, and 62/033,631, filed Aug. 5, 2014, each of which is hereby incorporated by reference.

FIELD OF THE DISCLOSURE

The present disclosure relates to lids or caps for drinking containers. More particularly, the present disclosure relates to a sports cap for use with relatively rigid, vacuum insulated flasks.

BACKGROUND OF THE DISCLOSURE

As people lead increasingly active lives, they may require an increased intake of liquids, which users may prefer to consume on the go and/or at a particular temperature. Containers such as sports bottles or insulated flasks may provide the user the convenience of readily available liquids maintained at a particular temperature. In addition, users may want to consume liquid from the container without removing the lid from the container, requiring a lid or cap that provides access to the liquids.

Caps with nozzles that can be extended to provide access to liquid within a container are commonly used with compressible bottles, such as plastic bike or sports bottles. However, insulated bottles and flasks are sometimes rigid-walled and incompressible, which can make the use of a conventional cap with a nozzle problematic, because it is not possible to change the volume of air within the bottle. Therefore, with a typical nozzle design that does not allow air to flow into the bottle as fluid flows out, a partial vacuum is created within the rigid-walled bottle as liquid is removed through the nozzle, making it progressively more difficult to drink from the bottle until the user stops drinking and allows air to flow back into the bottle through the nozzle. Accordingly, many lids or caps used in combination with insulated flasks and bottles are configured to be removed prior to consuming to provide access to the liquid. There is a need for bottle cap designs that incorporate nozzles suitable for use with rigid-walled bottles and flasks.

The following are hereby incorporated by reference in their entirety for all purposes: U.S. Design Pat. Nos. D633,338, D654,793, and D632,524.

SUMMARY OF THE DISCLOSURE

Systems and methods of the present disclosure are related to a sports cap for use with a relatively rigid bottle or flask. In accordance with the present disclosure, a sports cap is provided for facilitating consumption of liquid from a drinking container. One or more embodiments of the present disclosure may include a sports cap that allows a user to consume liquid from a container without removing a cap or lid, thus helping to maintain the temperature of the liquid in the container. One or more embodiments of the present invention may include a sports cap that is insulated to further maintain the liquid at a particular temperature while providing access to the liquid. In accordance with the present disclosure, a sports cap facilitates the formation of an enclosed volume within the assembly body of a liquid dispensing assembly or accessory for rigid-walled liquid containers.

An embodiment of a cap for a bottle may comprise a body and nozzle. The body may include an annular wall, an aperture configured to receive a nozzle, and a plug rigidly attached within the aperture. The nozzle may be movable between a retracted position in which fluid cannot pass between plug and nozzle, and an extended position in which fluid can pass between plug and nozzle. The nozzle may include an inner wall and an outer wall. The outer wall may have at least one longitudinal recess. The longitudinal recess may allow selective passage of air. The longitudinal recess may allow air to flow through the recess and into the bottle when the nozzle is in the extended position, and may prevent air from flowing through the recess and into the bottle when the nozzle is in the retracted position.

BRIEF DESCRIPTION OF THE DRAWINGS

Advantages of the present disclosure will be more readily understood after considering the drawings and the Detailed Description.

The drawings illustrate various embodiments of bottle caps according to aspects of the present disclosure. The purpose of these drawings is to aid in explaining the principles of the present disclosure. Thus, the drawings should not be considered as limiting the scope of the present disclosure to the embodiments shown therein. Other embodiments of caps may be created which follow the principles of the present disclosure as taught herein, and these other embodiments are intended to be included within the scope of the present disclosure.

DETAILED DESCRIPTION OF THE DISCLOSURE

FIGS. 1-5 depict a first embodiment of a bottle or flask cap, generally indicated at 10, according to aspects of the present disclosure. Cap 10 includes a body 12, a nozzle 26, and a venting system 49. FIGS. 1-5 portray a generally cylindrical cap, but other shapes or dimensions may be appropriate depending on the size and shape of a bottle for use with the cap. Cap 10 may be made of one or more suitable materials, including plastic, aluminum, or steel, among others.

Figure 1:
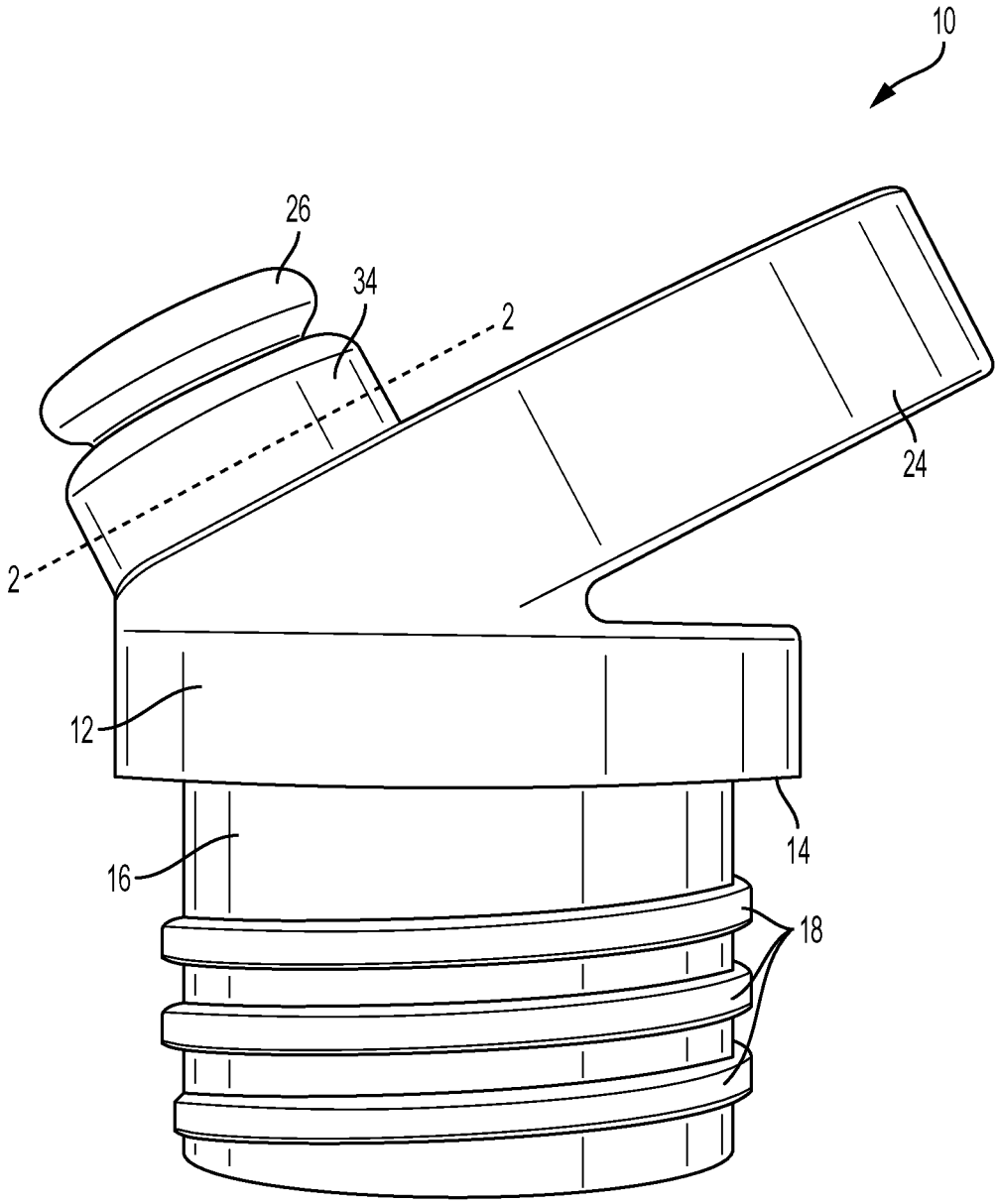
FIG. 1 shows a perspective view of an embodiment of a cap with a body and a nozzle in a retracted position.
Figure 2:
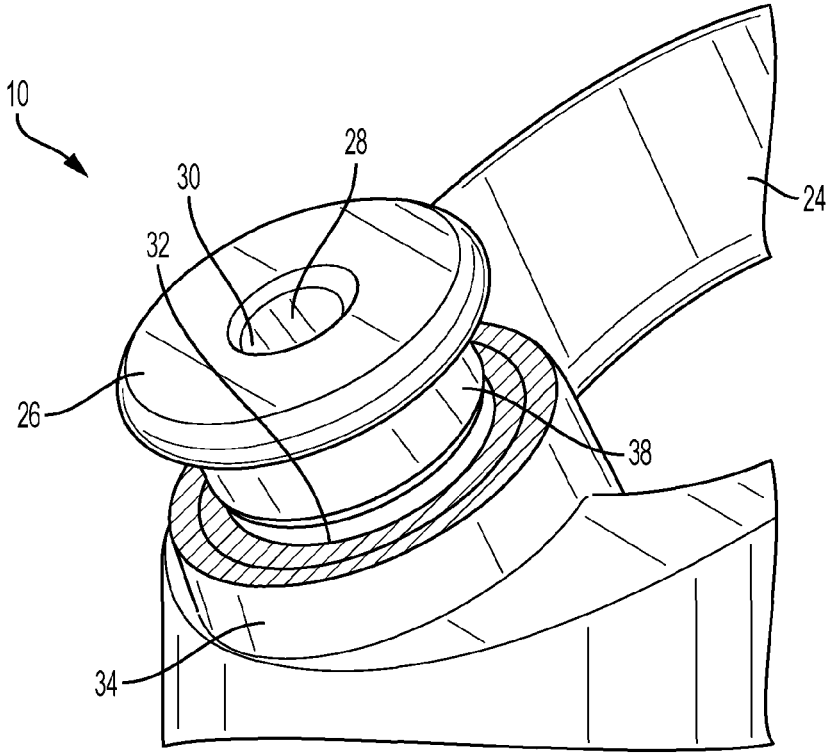
FIG. 2 shows an enlarged view of the embodiment of FIG. 1, with the nozzle in a retracted position and with cap material above the line 2-2 in FIG. 1 removed for clarity.
Figure 3:
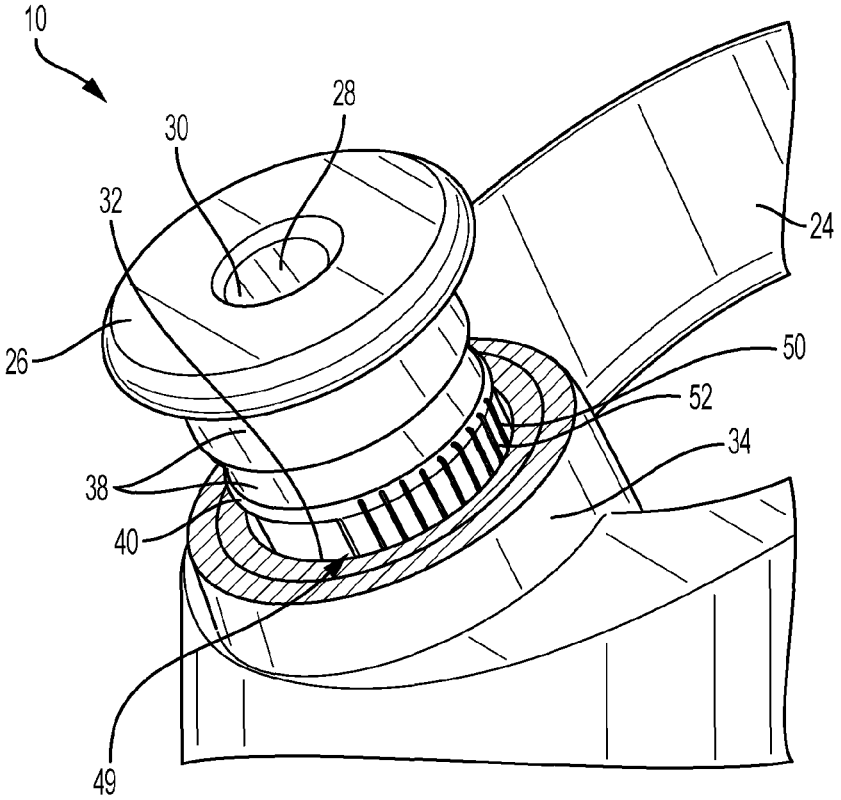
FIG. 3 shows an enlarged view of the embodiment of FIG. 1, with the nozzle in an extended position and with cap material above the line 2-2 in FIG. 1 removed for clarity, showing a set of longitudinal recesses in an outer wall of the nozzle.
Figure 4:
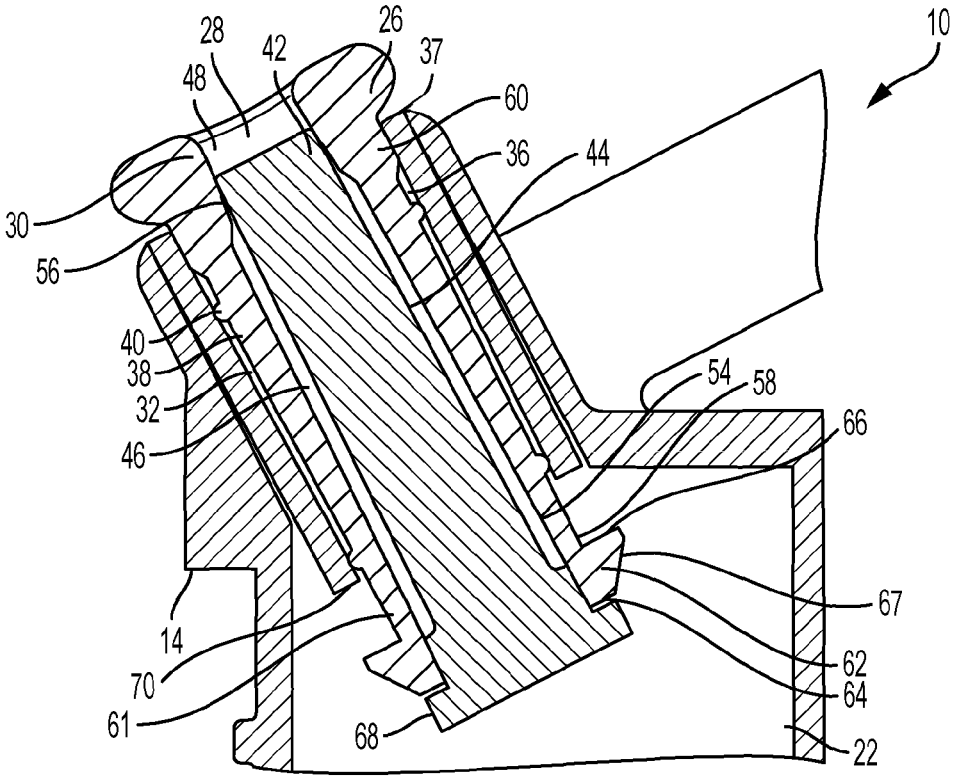
FIG. 4 shows an enlarged, cross-sectional view of the embodiment of FIG. 1, with the nozzle in a retracted position, where the section is taken vertically along a central axis of the cap with respect to FIG. 1.
Figure 5:
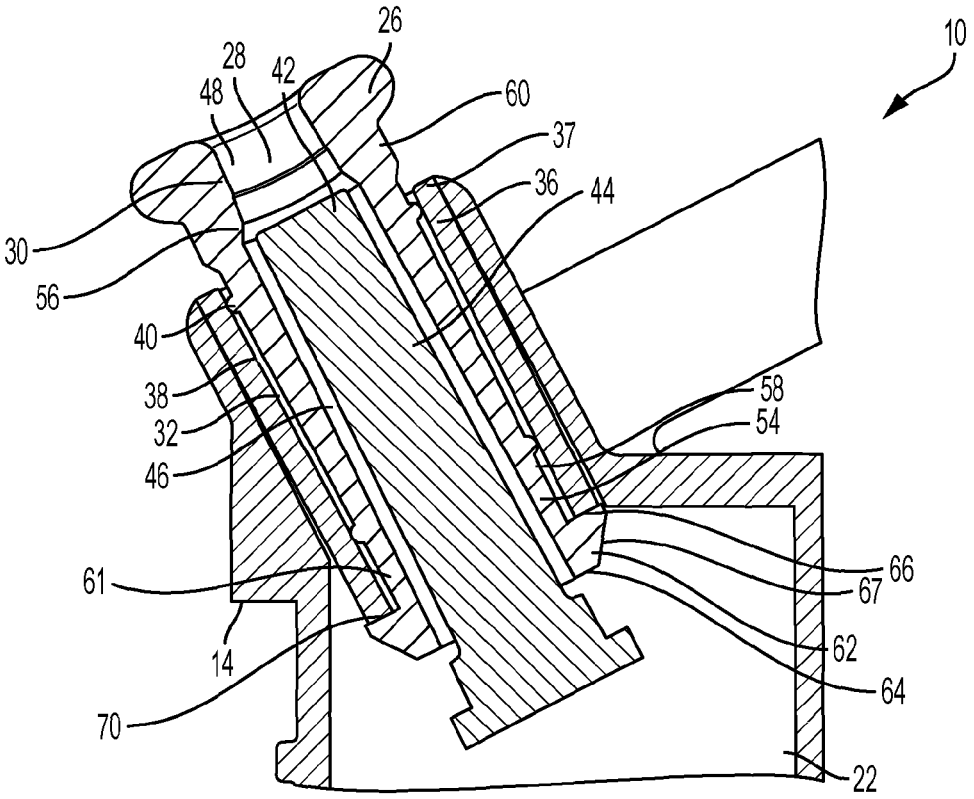
FIG. 5 shows an enlarged, cross-sectional view of the embodiment of FIG. 1, with the nozzle in an extended position, where the section is taken vertically along a central axis of the cap with respect to FIG. 1.

FIG. 1 is a perspective view of cap 10 showing body 12 and nozzle 26 in a retracted (closed) position. FIGS. 2-3 are enlarged views of an upper portion of cap 10 with material removed above the line 2-2 in FIG. 1, where the nozzle is in a retracted position in FIG. 2 and an extended position in FIG. 3. FIGS. 4-5 are sectional views of cap 10 taken along a central vertical plane with respect to FIG. 1, where the nozzle is in a retracted position in FIG. 4 and an extended position in FIG. 5. As seen in the sectional views of FIGS. 4-5, body 12 may include an annular wall 14 configured to engage a mouth of a bottle. In some embodiments, body 12 may include a seal (not shown), such as a ring seal, disposed circumferentially within annular wall and/or around body to help create a liquid tight closure when the cap is secured to a bottle. Body 12 may be shaped to enclose or partially enclose one or more components of cap 10. Body 12 may be configured to facilitate thermal retention, such as by having a vacuum, double-walled construction and/or including insulating foam.

Body 12 includes an attachment extension 16 that may be removably screwed to a bottle. The attachment extension includes one or more screw threads 18 that may engage with complementary screw threads on a bottle. In other embodiments, the attachment extension may be configured to slip-on and/or snap-on to a bottle. In some embodiments, body 12 may be configured to help a user remove and/or tighten the cap, such as by including a non-slip gripping material or slots that can be engaged by a user's fingers. Attachment extension 16 may form an annular space or a chamber 22 (see, for example, FIGS. 4-5). Chamber 22 may be configured to facilitate thermal retention, such as by having a vacuum, double-walled construction and/or including insulating foam. The chamber may be empty, filled with a gas characterized by low thermal energy transfer or filled with a material characterized by porosity and elevated insulating ability, i.e. a relatively high R-value.

Body 12 includes a loop 24 extending away from the body. Loop 24 may, for example, provide a user with a way to easily transport and/or secure a cap and/or bottle connected to a cap. Loop 24 may be angled approximately 45 degrees from annular wall 14 of body to facilitate access to the loop. In other embodiments, the loop may vary in angle, size, and/or shape.

Body 12 also includes an aperture 32 (see, for example FIGS. 2-3), which may be disposed generally opposite annular wall 14. Aperture 32 may have any suitable cross sectional shape to receive a nozzle or valve assembly, such as circular, oval, triangular, or square. In the embodiment of FIGS. 1-5, aperture 32 is circular and includes a cylindrical inner surface 36 extending or elongating into the body and/or chamber 22. Aperture 32 may be disposed or partially disposed in a protrusion 34 on body 12. The size and dimensions of protrusion 34 may be determined by the size and shape of the body and/or nozzle. In some embodiments, protrusion 34 may be sized to provide a user with easier access to the nozzle.

Nozzle 26 includes an outer wall 38 and an inner wall 30 defining an interior bore 28 (see, for example, FIG. 2). Interior bore 28 may be a cylindrical void or hollow passageway running the length of nozzle. Interior bore 28 is configured to be in fluid communication with the liquid contents of a bottle to which cap 10 is secured. Nozzle 26 may be slidably engaged with body 12 between a retracted position (see, for example FIGS. 1-2, and 4) and an extended position (see, for example, FIGS. 3 and 5) to allow a user to control release of liquid from a bottle or flask to which cap 10 is secured. More specifically, nozzle 26 may be configured to move between a retracted position in which liquid cannot pass through interior bore 28, and an extended position in which liquid can pass through the interior bore.

Venting system 49 may permit air to enter a bottle as liquid is dispensed from the bottle when nozzle is in an extended position, and to prevent air from entering the bottle when the nozzle is in a retracted position. This allows air to pass through the venting system and into the bottle as liquid passes out through the nozzle, which maintains a relatively constant air pressure with the bottle and avoids the problem of the partial vacuum created with a lid when a conventional nozzle is used on a rigid-walled bottle or flask.

For example, with reference to FIG. 3, cap 10 includes a plurality of longitudinal recesses 50 formed in outer wall 38 of nozzle 26. Longitudinal recesses 50 may define one or more inner surfaces 52, and are disposed around a portion of the perimeter of outer wall 38 of the nozzle. The longitudinal recesses will be sealed inside body 12 in an airtight manner when the nozzle is in its retracted position. When the nozzle is in its extended position, however, the longitudinal recesses provide a channel for air to pass through the cap and into the bottle or flask to which the cap is attached. In some cases, the longitudinal recesses may remain enclosed or hidden inside body 12 even when the nozzle is extended, while still providing a channel for air to pass into the bottle. For example, longitudinal recesses 50 may terminate proximate to an outer edge 37 of aperture (see, for example, FIGS. 4-5). In other embodiments, the longitudinal recesses may be at least partially exposed and in view outside body 12 when the nozzle is in its extended position.

As described above, each longitudinal recess 50 is configured to allow air to flow through the recess and into a bottle when nozzle 26 is in an extended position, and to prevent air flow through the recess and into the bottle when the nozzle is in a retracted position. At the same time, as described below, longitudinal recesses 50 may be configured to inhibit water from flowing out through the recess due to capillary action.

More specifically, longitudinal recesses 50 may be made of one or more suitable low surface energy materials, such as silicone or polypropylene, among others. Furthermore, recess 50 may have dimensions configured to allow sufficient passage of air while minimizing or avoiding unwanted passage of liquid. For example, longitudinal recesses 50 each may have a cross sectional area of approximately 0.1 square millimeters to 0.5 square millimeters, and the plurality of longitudinal recesses provided may have a total cross sectional area of approximately 3 square millimeters to 15 square millimeters. More generally, the longitudinal recesses may vary in size and/or shape to facilitate selective passage of air and/or inhibit capillary action.

The low surface energy of the silicone, polypropylene, or other chosen material, combined with the dimensions of the longitudinal recesses, may prevent the flow of liquid in either direction through the recesses but allow for the passage of air from outside body 12 into chamber 22 and/or a bottle or flask to which cap 10 is attached via one or more of the longitudinal recesses. This configuration may allow a user to consume liquid from nozzle 26 of cap 10 attached to a non-squeezable, non-deformable, incompressible, and/or metal bottle without requiring the user to stop drinking so that air can pass through the main bore of the nozzle and alleviate the partial vacuum created when liquid passes out of the bottle.

More specifically, with nozzle 10 in the extended (or open) position, fluid may flow out from a bottle and/or chamber 22 of body 12 through interior bore 28 of nozzle 26, and air may be simultaneously vented into the chamber of body 12 and/or the bottle via one or more of longitudinal recesses 50. On the other hand, when the nozzle is in the retracted (or closed) position, fluid is blocked from flowing out from the bottle and/or chamber 22 of body 12 through interior bore 28 of nozzle 26, and the longitudinal recesses 50 may be sealed inside body 12, so that air and fluid cannot flow through the longitudinal recesses.

Outer wall 38 of nozzle 26 may include one or more guide protrusions 40 to hold the nozzle in a stable orientation with respect to the aperture. Guide protrusion 40 may have a diameter approximately equal to or slightly greater than the diameter of inner surface 36 of aperture 32 (see, for example, FIGS. 4-5), and may be resilient enough to be compressed within aperture 32. Guide protrusion 40 may, for example, be slidably engaged with inner surface 36 to facilitate movement of nozzle 26 between an extended position and retracted position. Guide protrusion 40 may be disposed around a portion or entire perimeter of the outer wall. One or more guide protrusions 40 may be disposed adjacent to one or more of longitudinal recesses 50. Guide protrusion 40 may be made from any suitable material, including silicone, polypropylene, or rubber, among others.

FIGS. 4-5 are enlarged, cross-sectional views of cap 10. FIG. 4 shows nozzle 26 in a retracted position. FIG. 5 shows nozzle 26 in an extended position. Body 12 includes a plug 42 rigidly attached to body 12 within aperture 32. Plug 42 defines an annular gap 46 between inner surface 36 of aperture 32 and an outer surface 44 of plug 42. Nozzle 26 may be shaped to fit within the annular gap and to move between a retracted position and an extended position. Plug 42 may extend through or partially through interior bore 28 of the nozzle, to selectively allow or prevent the passage of fluid through bore 28. In the embodiment of FIGS. 1-5, plug 42 is generally cylindrical, but other shapes may be used corresponding to the shape of the interior bore of the nozzle.

As depicted in FIG. 4, outer surface 44 of plug 42 may be shaped to be in physical contact with inner wall 30 of the nozzle when the nozzle is in a retracted position, thus providing a fluid tight seal between the plug and the inner surface of the nozzle. On the other hand, as depicted in FIG. 5, when the nozzle is in an extended position, the outer surface 44 of plug 42 may be out of physical contact with the nozzle, thus allowing the passage of fluid between the plug and the inner surface 48 of the nozzle. For example, inner wall 30 of the nozzle may have an upper diameter 56 tapering to become smaller than the diameter of plug 42, and a lower diameter 54 exceeding the diameter of plug 42.

In addition to providing a selectively fluid tight seal against plug 42, nozzle 26 is also configured to provide a selectively fluid tight seal against inner surface 36 of aperture 32. For example, as depicted in FIGS. 4-5, outer wall 38 of the nozzle may have an upper diameter 60 tapering to become larger than the diameter of inner surface 36 of the aperture, thus preventing the flow of air through longitudinal recesses 50 when the nozzle is in the retracted position. On the other hand, outer wall 38 may have a lower diameter 58 smaller than the diameter of inner surface 36 of aperture, allowing air to flow through the longitudinal recesses when the nozzle is in the extended position. In other embodiments, the size and tapering of nozzle may vary depending on size and/or shape of the aperture and/or the plug.

To facilitate selective passage of air as described above, the longitudinal recesses 50 may terminate proximate or below upper diameter 60. Longitudinal recesses 50 may extend the length or partial length of the nozzle and terminate proximate lower diameter 58 of the outer wall of the nozzle.

In summary, a fluid tight seal may be formed between inner wall 30 of nozzle 26 and outer surface 44 of plug 42 when the nozzle is in a retracted position, thus preventing fluid from flowing through the nozzle. Also when the nozzle is in a retracted position, a fluid tight seal may also be formed between outer wall 38 of nozzle 26 and inner surface 36 of aperture 32, thus preventing air from flowing through longitudinal recesses 50. In contrast, fluid may pass between outer surface 44 of plug 42 and inner surface 48 of nozzle 26 when the nozzle is in an extended position, thus allowing fluid to exit the bottle through the nozzle. Also when the nozzle is in an extended position, air may flow into the bottle through longitudinal recesses 50, thus alleviating the partial vacuum created within the bottle as fluid exits. This configuration, including the nozzle and venting system, facilitates the dispensing of liquid out of a rigid vessel and simultaneous venting of air to the inside of the rigid vessel when the nozzle is in the open or extended position, while maintaining effective insulation of the bottle contents when the nozzle is in the closed or retracted position.

Outer wall 38 of nozzle may include one or more stops, such as stop 62 depicted in FIGS. 4-5, disposed on a lower portion 61 of the outer wall. For example, stop 62 may extend outward from lower portion 61 of the outer wall of the nozzle. The stop may exceed the diameter of inner surface 36 of aperture 32. In this embodiment, stop 62 has a lower surface 64 and an upper surface 66 extending generally perpendicular from the outer wall. An outer surface 67 of the stop may be angled or chamfered. Lower surface 64 may extend a partial length of upper surface 66.

Lower surface 64 is configured to abut one or more complementary lips 68 of plug 42 when the nozzle is in a retracted position, thus preventing further movement of nozzle into the aperture and/or the chamber 22. Upper surface 66 is configured to abut one or more complementary surfaces 70 within body 12 and/or chamber 22 when the nozzle is in an extended position, thus preventing further movement of the nozzle out of the aperture and/or the body of the cap. Other configurations of the cap to limit movement of the nozzle in one or both directions may be utilized as desired.

Figure 6:
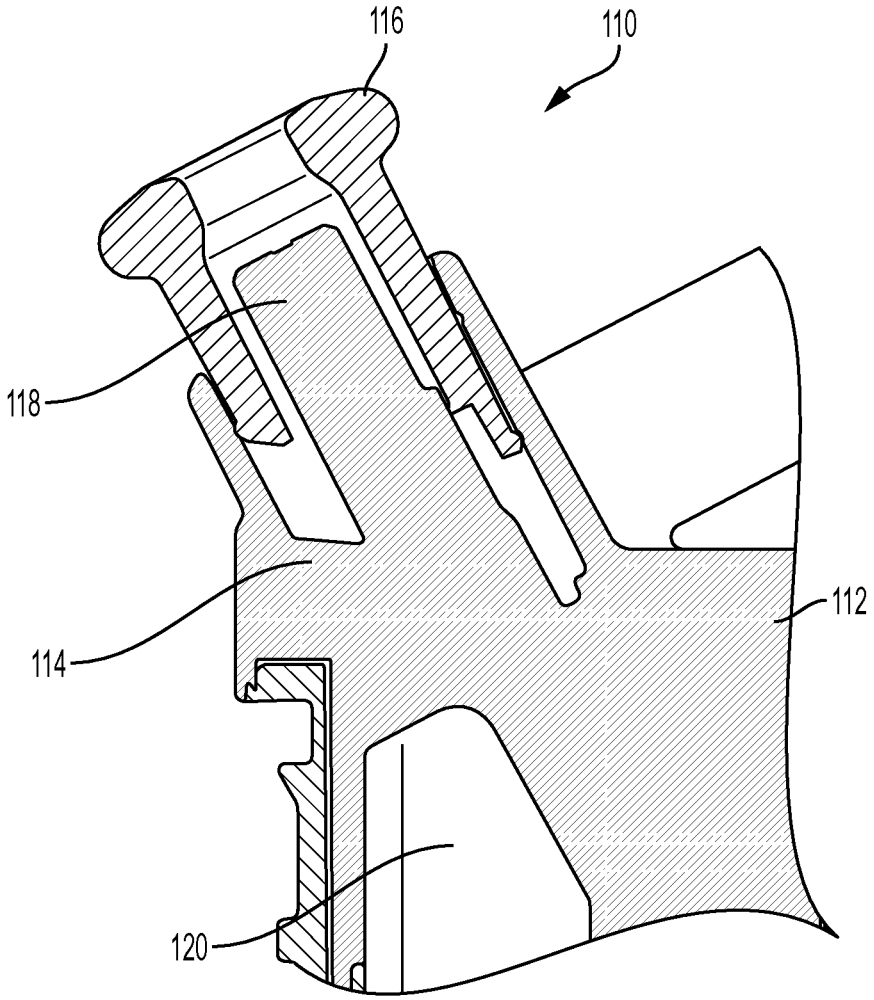
FIG. 6 shows an enlarged, cross-sectional view of another embodiment of a cap, with the nozzle in an extended position.

FIG. 6 is an enlarged, cross-sectional view of another embodiment according to the present teachings of a cap, generally indicated at 110, for a rigid-walled bottle or flask, showing a plug 118 supported by one or more support members 114 of a cap body 112. The embodiment of FIG. 6 demonstrates one possible way in which a plug such as plug 118 may be rigidly attached to surrounding portions of a bottle cap. A similar attachment structure can be used in the embodiment of FIGS. 1-5 or in other embodiments according to the present teachings. In FIG. 6, support members 114 are configured to hold plug 118 in a fixed orientation relative to body 112, while nozzle 116 moves between an extended position and a retracted position. Support members 114 may be shaped to define one or more chambers 120, which may contain a partial vacuum and/or insulating material.

Figure 8:
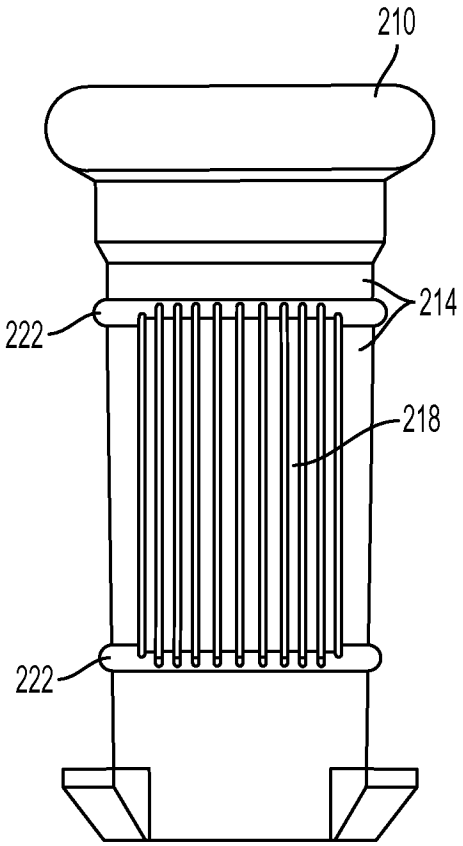
FIG. 8 shows a front elevational view of the nozzle of FIG. 7.
Figure 7:
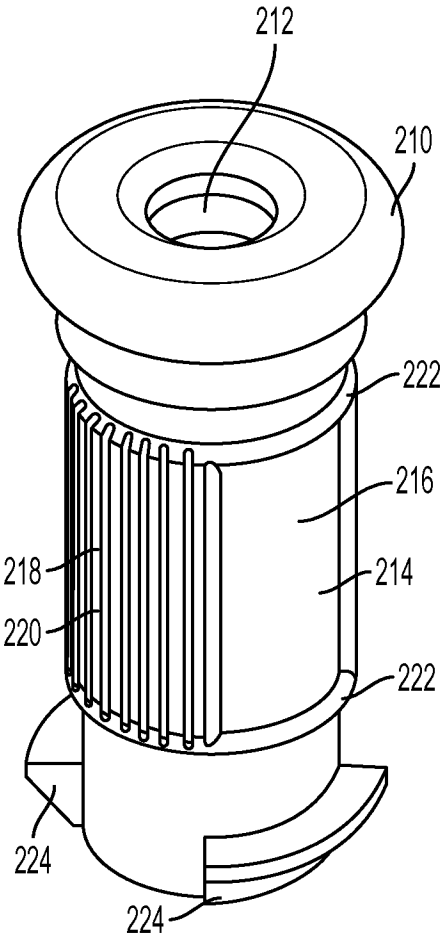
FIG. 7 shows a perspective view of another embodiment of a nozzle.

FIGS. 7-8 depict another embodiment of a nozzle, generally indicated at 210, according to aspects of the present teachings. FIG. 7 is a perspective view of nozzle 210, and FIG. 8 is an elevational view of the nozzle. Nozzle 210 may be configured to fit within body 12 of cap 10 and may include one or more features described above and shown in FIGS. 1-5. For instance, nozzle 210 may include an interior bore 212 and an outer wall 214. The outer wall may include one or more guide protrusions 222 and a venting system generally indicated at 216.

Venting system 216 includes longitudinal recesses 218 defining inner surfaces 220. Nozzle 210 also includes stops 224 disposed on the outer wall of the nozzle. The stops are configured to subtend a portion of the perimeter of the nozzle which is complementary to the portion subtended by the longitudinal recesses. This facilitates passive venting of the venting system, by permitting the passage of air between the stops when the nozzle is in an extended position within a cap. Longitudinal recesses 218 extend to guide protrusion 222 on the outer wall of the nozzle. In other embodiments, the longitudinal recesses may extend entirely through and/or beyond one or more guide protrusions.

Figure 9:
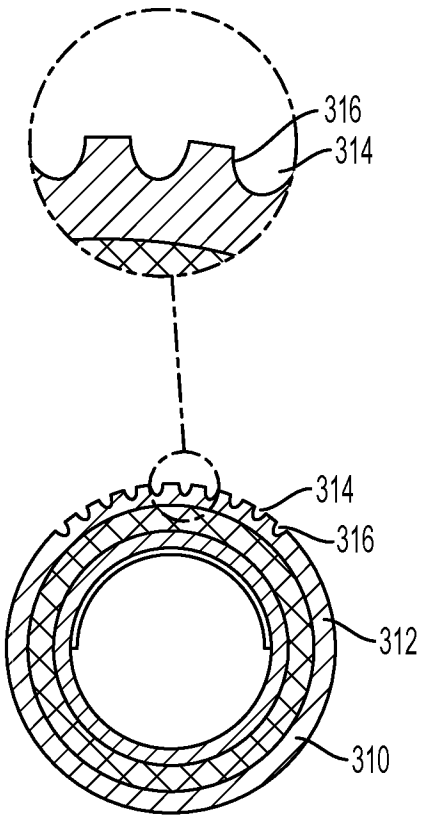
FIG. 9 shows a cross-sectional view of another embodiment of a nozzle, showing a magnified view of longitudinal recesses.

FIG. 9 is a cross-sectional view of yet another embodiment of a nozzle, generally indicated at 310, according to aspects of the present teachings. FIG. 9 is a magnified view of a plurality of longitudinal recesses 314 formed in an outer wall 312 of the nozzle, depicting an exemplary shape of recesses 314. Specifically, an inner surface 316 of longitudinal recess 314 may form a longitudinal groove having a uniform, substantially parabolic or U-shaped cross section. This shape formed in the longitudinal recess may serve to help the inner surfaces from collapsing and facilitate air movement within the recess. In other embodiments, the inner surface of the longitudinal recess may take other shapes.

Figure 10:
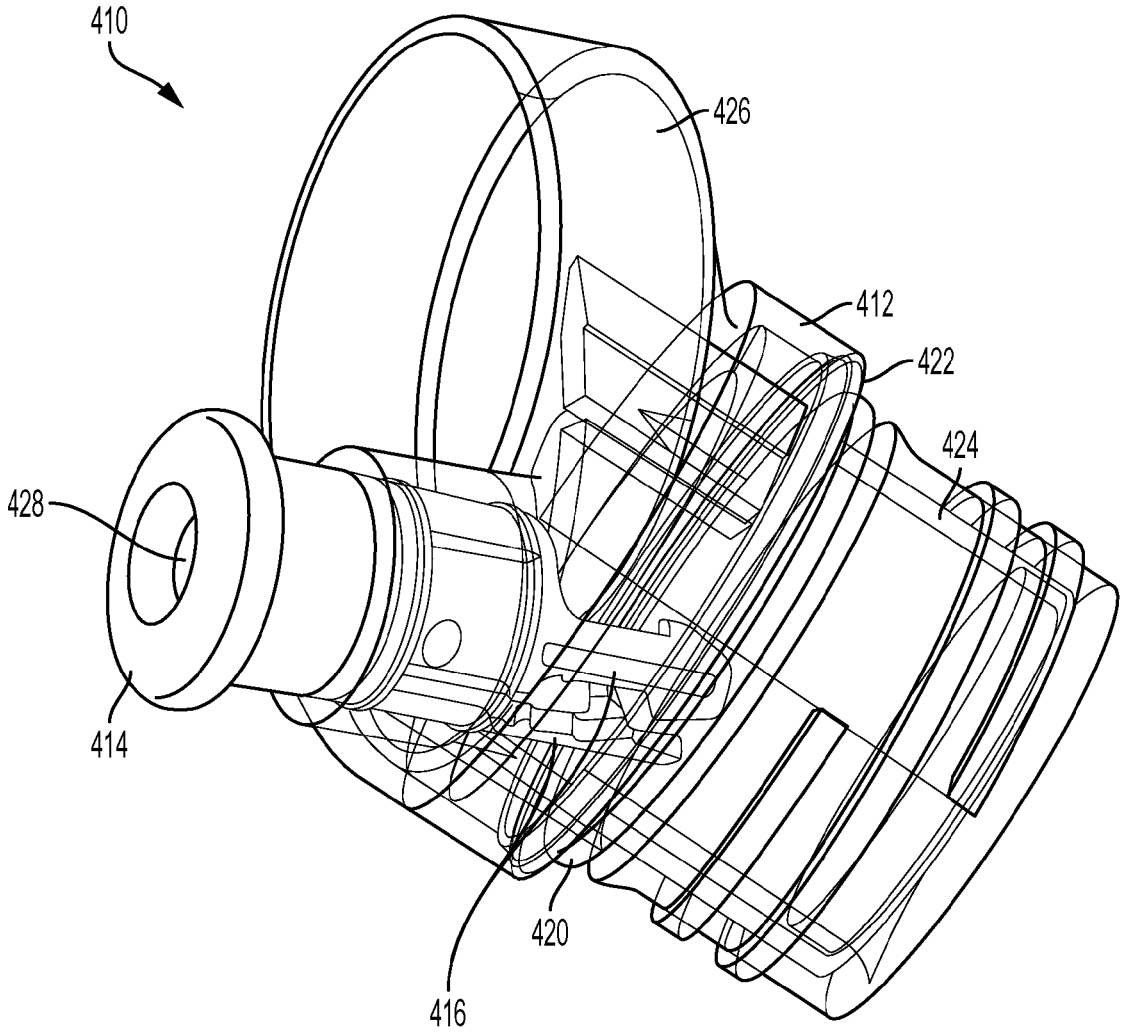
FIG. 10 shows a perspective view of another embodiment of a cap, with a nozzle in an extended position.
Figure 11:
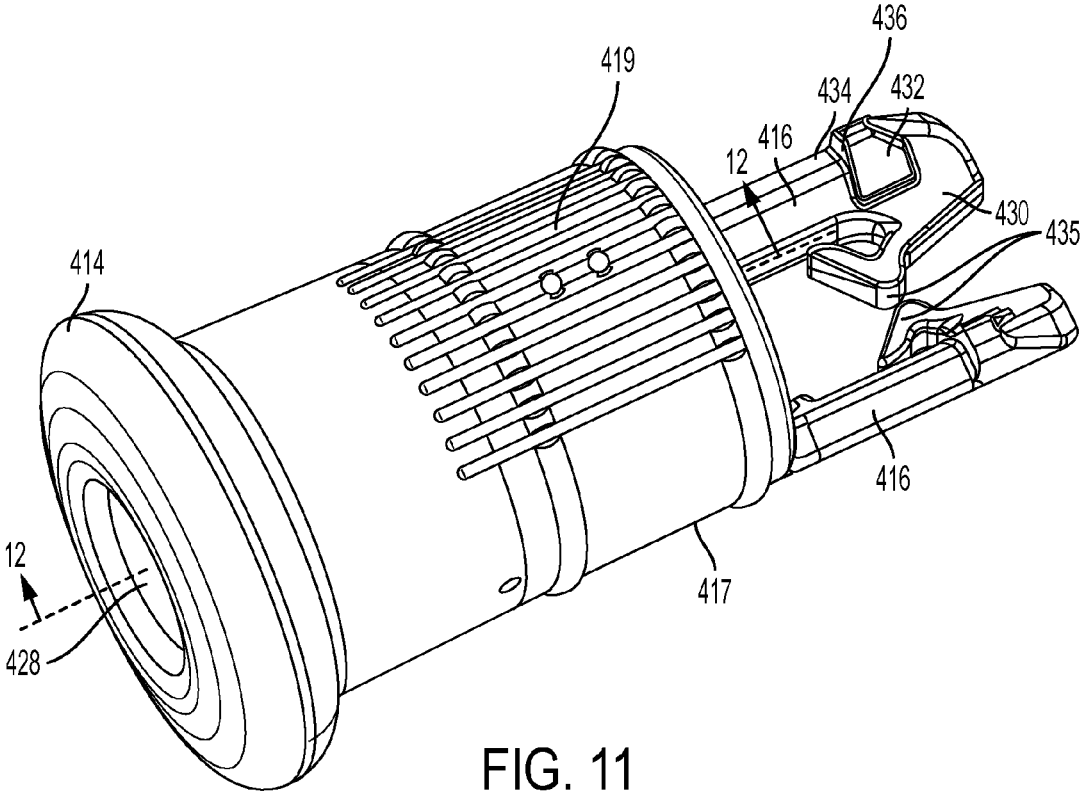
FIG. 11 shows a perspective view of the nozzle of the embodiment of FIG. 10.

FIGS. 10-19 depict still another embodiment of a cap, generally indicated at 410, according to aspects of the present teachings. FIG. 10 depicts cap 410 including a body 412 and a nozzle 414 disposed in an extended position, and FIG. 11 depicts nozzle 414 removed from body 412. Most of the features of this embodiment may be the same or similar to one or more embodiments described above and shown in FIGS. 1-9. For example, body 412 may have an annular wall 422, an attachment extension 424, and a loop 426. Nozzle 414 may have an interior bore 428 and one or more longitudinal recesses 419 on an outer wall 418. Body 412 may include a seal 420 disposed circumferentially around the body proximate to the annular wall.

Nozzle 414 includes leg portions 416 attached to a lower portion 417 of the nozzle. Leg portions 416 may be configured to limit movement of the nozzle outside a predetermined range of movement between a retracted (closed) position and an extended (open) position, as described in more detail below. FIGS. 10-15 portray two leg portions 416, but other embodiments may utilize any suitable number of leg portions, such as one, three, or more, to limit movement of the nozzle. FIGS. 10 through 19 portray a generally cylindrical body and nozzle, but other shapes or dimensions may be appropriate depending on the size and shape of a bottle for use with the cap.

FIG. 11 shows nozzle 414 with leg portions 416 extending from the lower portion of the nozzle. Leg portions 416 may include a stop 432 disposed on a distal end 434 of each leg portion. The stop may have an upper surface 436 extending generally perpendicular from the leg portion. Upper surface 436 of the stop may be configured to abut one or more complementary surfaces within body 412 when the nozzle is in an extended position. Distal end 434 of the leg portion may include a foot member 430 extending generally inwards and curving back towards the leg portion forming a projection 435. Stop 436 may be configured to extend away from the leg portion when pressure is applied against projection 435. For example, stop 436 may be configured to rotate outward. When the stop extends away from the leg portion, the upper surface 436 of the stop may be exposed and facilitate the upper surface making physical contact with one or more complementary surfaces within the body of the nozzle. In some embodiments, the stop may be rigidly attached to leg portion 416 and positioned to abut one or more complementary surfaces within body 412 when the leg portion is moved outward.

Leg portions 416 may be biased to flex inwards generally towards an interior bore 428 of the nozzle. When the nozzle is in a retracted position, cap 410 is configured to allow the leg portions to engage complementary detents within the cap, thus providing a force to hold the nozzle in its retracted position, and which must be overcome to move the nozzle away from the retracted position. When the nozzle is in an extended position, cap 410 is configured to apply outward pressure against the leg portions, thus pushing the leg portions outwards. For example, when pressure is applied against projection 435 of foot member 430, leg portions 416 may flex outward. This outward movement of the leg portions may facilitate stop 432 to abut one or more complementary surfaces within body 412, thus limiting movement of the nozzle outside a predetermined range of movement and preventing the nozzle from being pulled entirely out of the cap.

Leg portions 416 also may be configured to facilitate release of the nozzle from the body of the cap when desired, for instance in order to clean or replace the nozzle. For example, a predetermined amount of force against the leg portions 416 may release the leg portion and the nozzle from the cap. Leg portions 416 may be made from any suitable material, for example, a polypropylene hard plastic substrate. In some embodiments, the leg portions may include a spring mechanism operably connected to the stop, rather than merely being biased toward a certain position.

Figure 12:
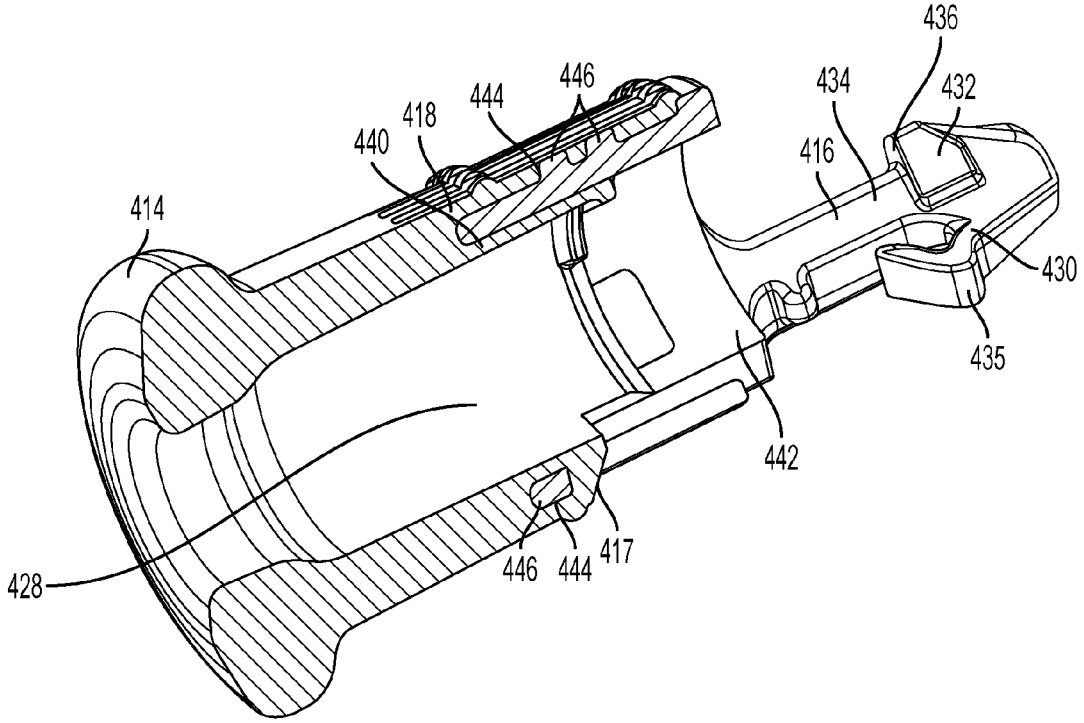
FIG. 12 shows a cross-sectional view of the nozzle of FIG. 11, taken along the line 12-12 in FIG. 11.

FIG. 12 is a cross-sectional view of nozzle 414 showing one leg portion 416 including an annular ring 442 attaching the leg portion to the nozzle. Annular ring 442 is configured to attach the leg portion to lower portion 417 of the nozzle and extend between outer wall 418 and inner wall 440 of the nozzle. The nozzle may have attachment slots 444 within the outer wall and/or the inner wall configured to receive attachment tabs 446 on the annular ring. The annular ring may be releasably attached to the nozzle.

Figure 13:
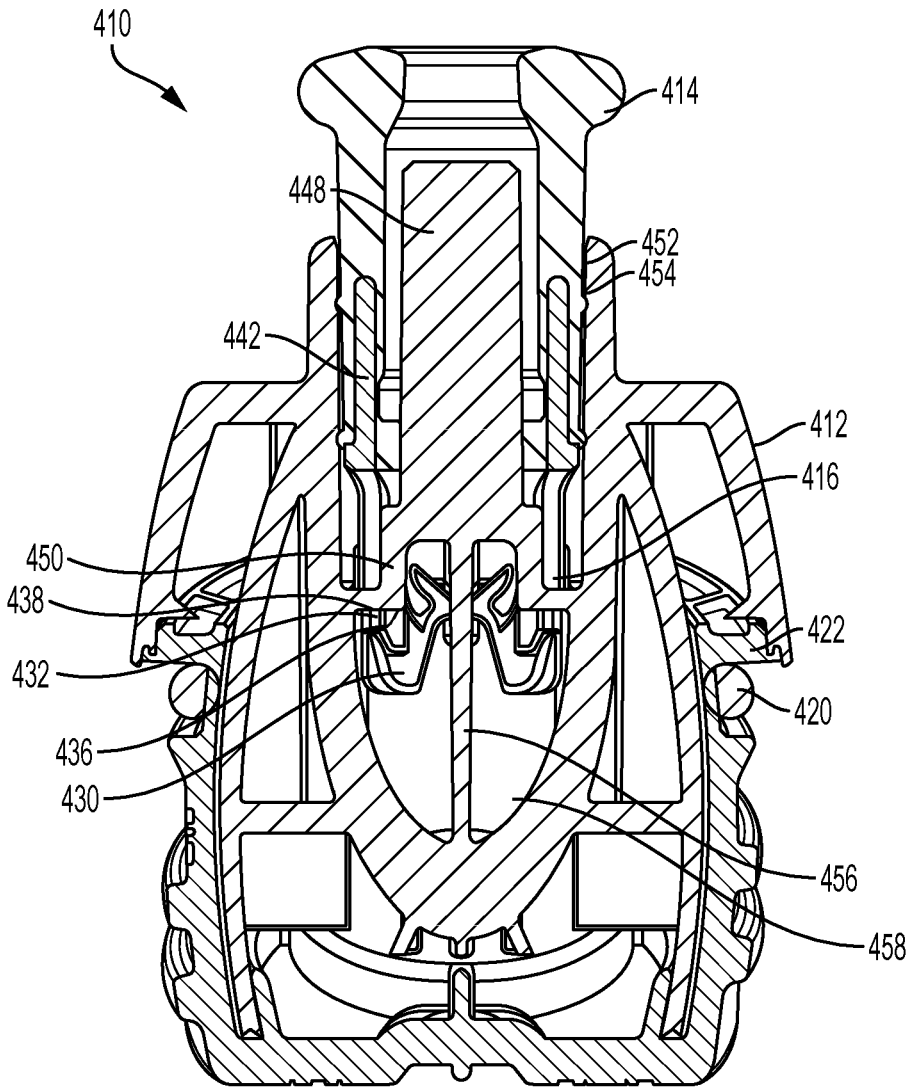
FIG. 13 shows a cross-sectional view of the embodiment of FIG. 10, with the nozzle in an extended position, taken along a line that bisects the cap nozzle in FIG. 10.
Figure 14:
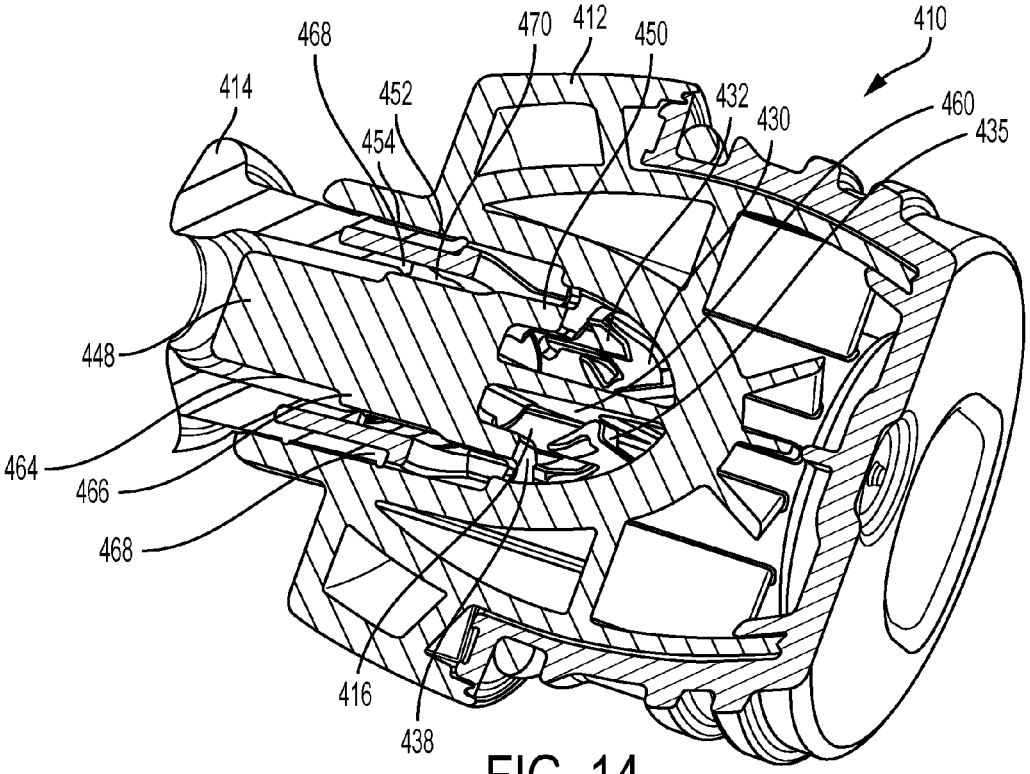
FIG. 14 shows a perspective view of the sectional view of FIG. 13.
Figure 15:
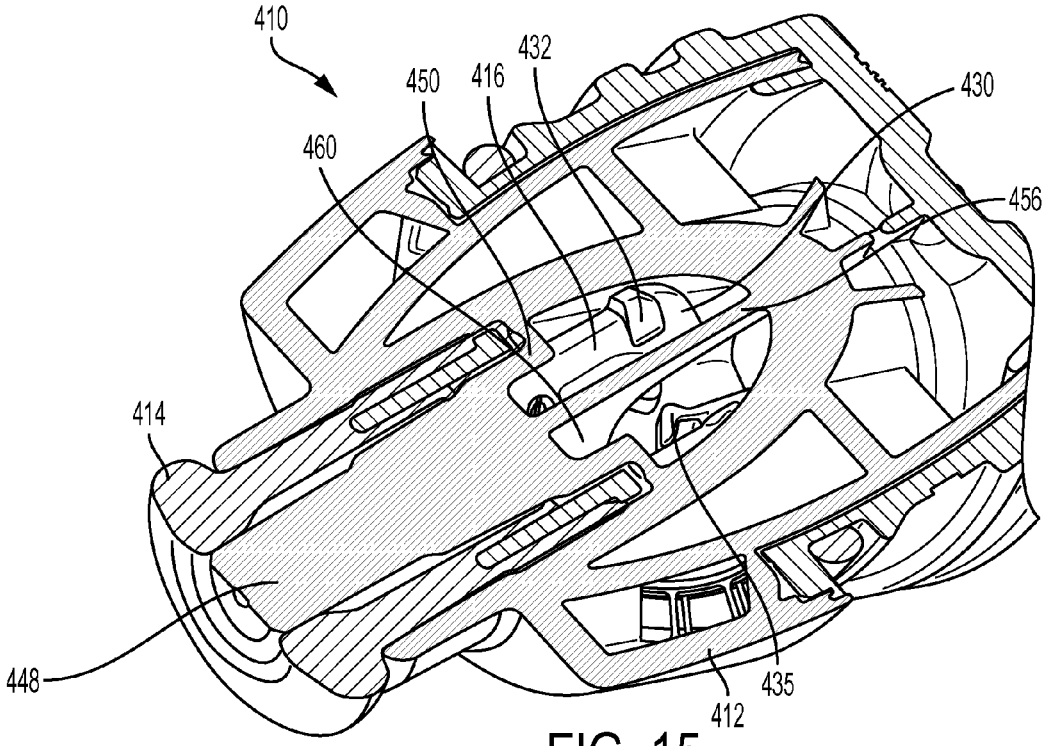
FIG. 15 shows another perspective view of the sectional view of FIG. 13.

FIGS. 13-15 are cross-sectional views of cap 410, showing further details of the internal structure of the cap. FIGS. 13-14 show nozzle 414 in an extended position. FIG. 15 shows nozzle 414 in a retracted position. Body 412 includes an aperture 452 shaped to receive nozzle 414 and configured to allow movement between the extended position and the retracted position while facilitating venting of air between longitudinal recesses 419 and an inner surface 454 of aperture 452. Plug 448 is rigidly attached within aperture 452 of body 412 with support members 450. Support members 450 may attach to the inner surface of the aperture and/or within the body. Support members 450 may be shaped to prevent further movement of the nozzle into the aperture. The support members may have one or more surfaces 438 configured to abut upper surface 436 of stop 432 when the nozzle is in the extended position. A central support member 456 may be rigidly attached to the plug extending between the plug and a lower portion 458 of the aperture.

As depicted in FIG. 14, central support member 456 may be configured to apply pressure against projection 435 of foot member 430 when nozzle 414 is in an extended position, thus causing leg portions 416 to extend outward. For example, an upper portion 462 of the central support member may include a panel 460 shaped to make physical contact with projection 435 of foot member 430 when the nozzle is in the extended position. On the other hand, as depicted in FIG. 15, when the nozzle is in a retracted position, central support member 456 or panel 460 may not be in physical contact with the projection or any portion of the foot member, thus allowing leg portions 416 to be disposed in a retracted position. In other embodiments, the central support member or panel may be tapered to provide a gradual increase in pressure against the projection of the foot member when the nozzle moves from a retracted position to an extended position.

As depicted in FIG. 14, cap 410 may be configured to limit movement of air between nozzle 414 and plug 448 when the nozzle is in an extended position. For example, the cap may include an air separation baffle 470 between the nozzle and the plug. Air separation baffle 470 may be formed by a shoulder 466 on an outer surface 464 of the plug, and an inner lip 468 of the nozzle. The shoulder may be shaped to maintain physical contact with the inner lip of the nozzle. The shoulder may subtend less than 360 degrees to allow movement of liquid from bottle through the interior bore. This configuration may help prevent air from escaping the bottle when water is flowing through the interior bore, thus facilitating the dispensing of liquid and simultaneous venting of air to the inside of the rigid vessel when the nozzle is in the open or extended position.

Figure 16:
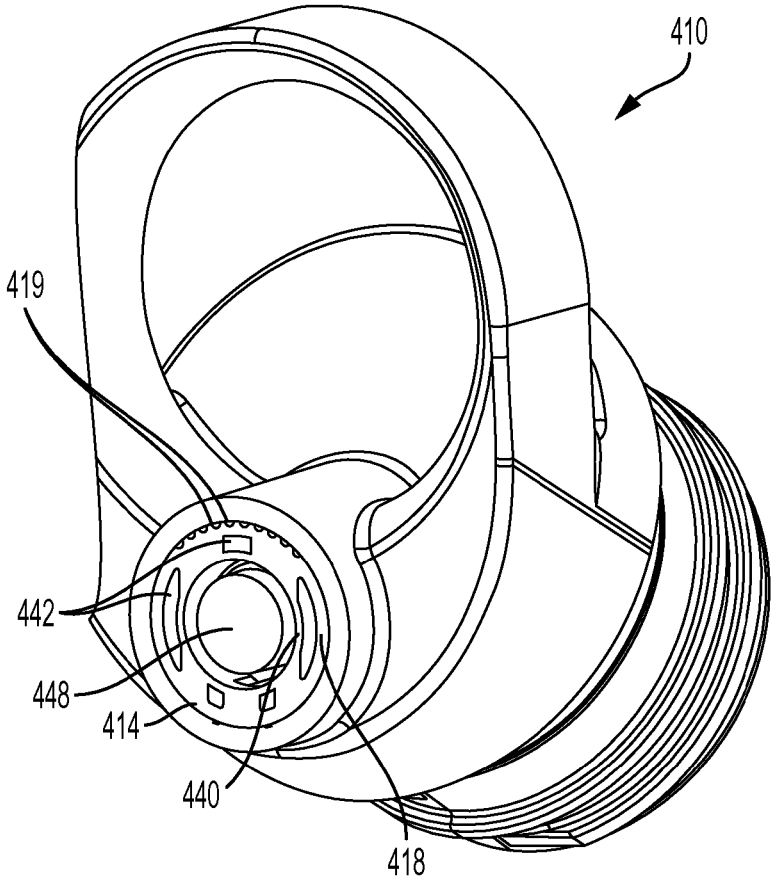
FIG. 16 shows a perspective view of the embodiment of FIG. 10, with distal cap material removed for clarity.
Figure 17:
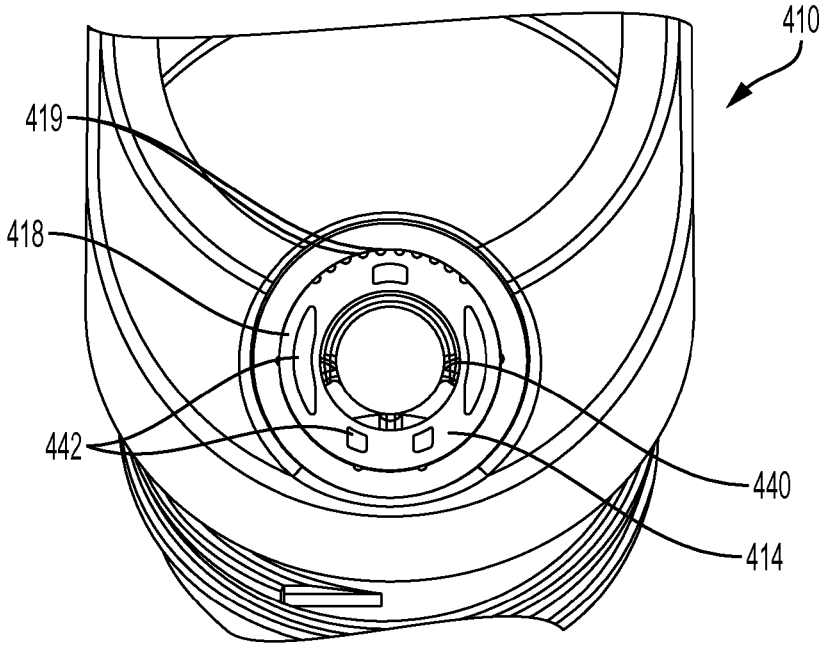
FIG. 17 shows another perspective view of the embodiment of FIG. 10, with distal cap material removed for clarity.
Figure 18:
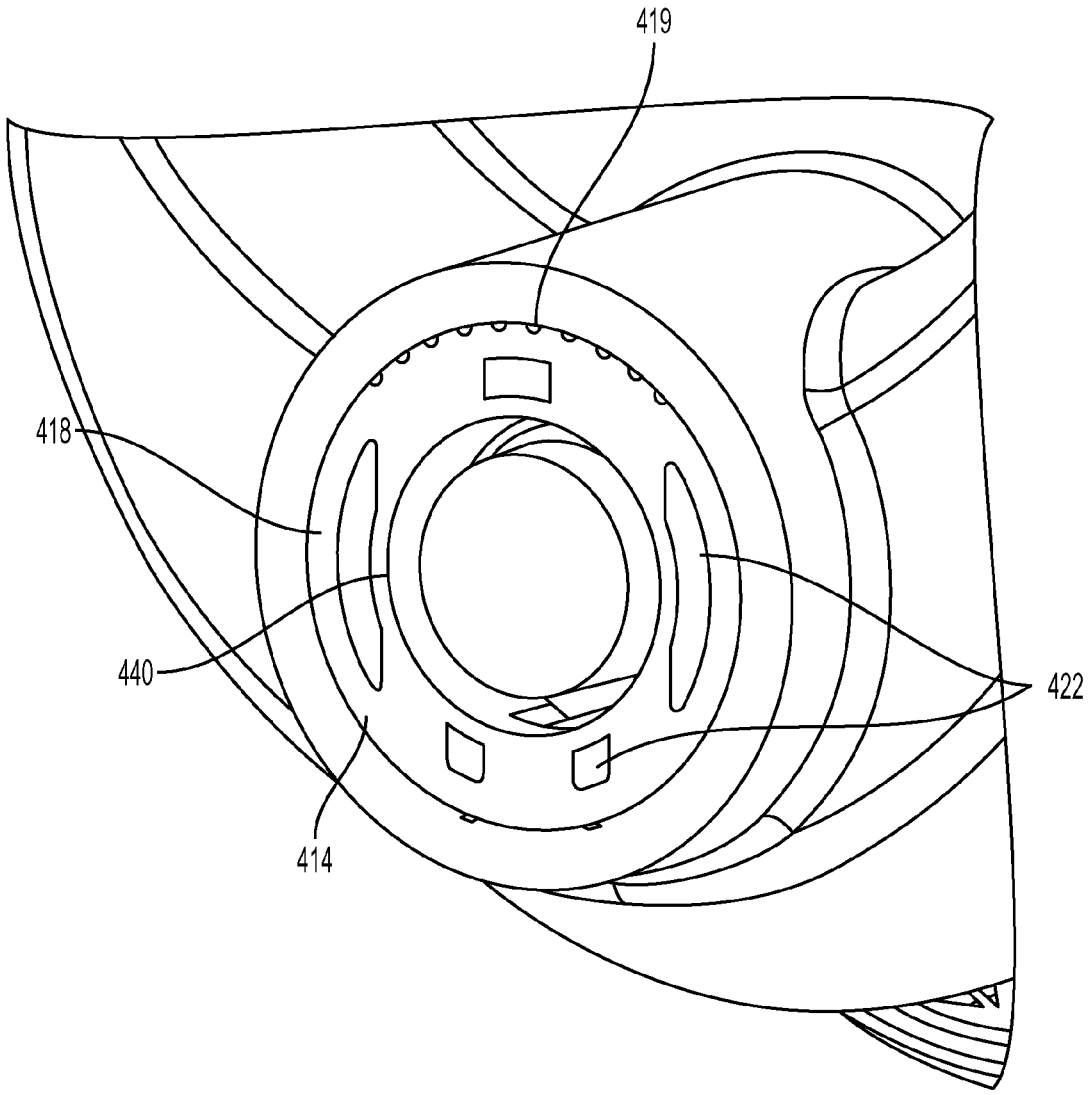
FIG. 18 shows an enlarged perspective view of the embodiment of FIG. 10, with distal cap material removed for clarity.

FIGS. 16-18 are perspective views of cap 410 with distal cap material removed for clarity. As seen in the views of FIGS. 16-18, nozzle 414 may include portions of annular ring 442 extending between outer wall 418 of the nozzle and inner wall 440 of the nozzle. Longitudinal recesses 419 may be formed in the outer wall of the nozzle.

Figure 19:
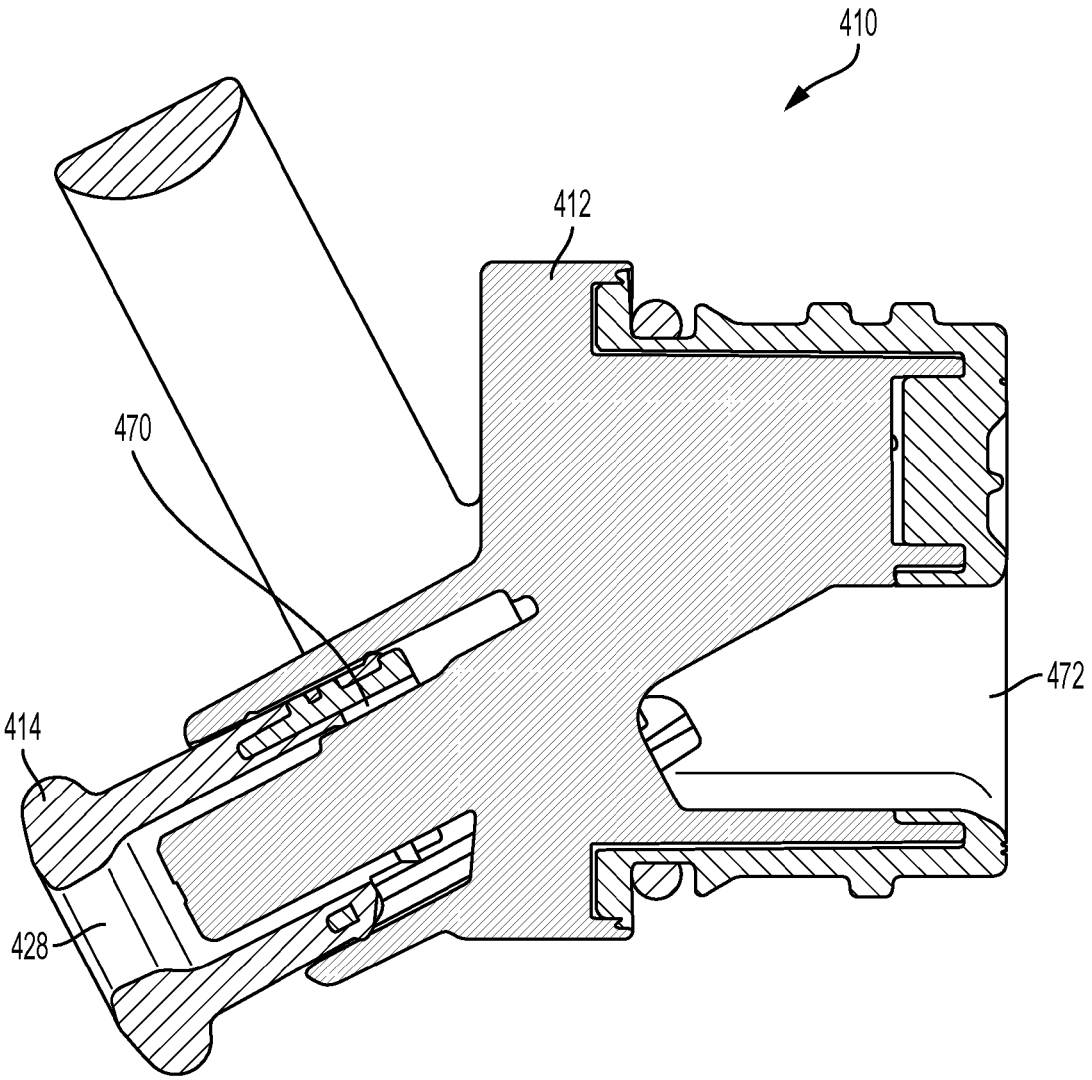
FIG. 19 shows a cross-sectional view of the embodiment of FIG. 10, with the nozzle in an extended position.

FIG. 19 is a cross-sectional view of cap 410 showing nozzle 414 in an extended position and air separation baffle 470. Body 412 may include an opening 472 extending into the body to interior bore 428 and configured to allow movement of the liquid from the bottle.

While embodiments of one or more caps have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The following is a list of applicable reference numbers, along with descriptions of each numbered component:

| Ref. No. | Description |
|---|---|
| 10 | Cap |
| 12 | Body |
| 14 | Annular Wall |
| 16 | Attachment Extension |
| 18 | Screw Thread |
| 22 | Chamber |
| 24 | Loop |
| 26 | Nozzle |
| 28 | Interior Bore |
| 30 | Inner Wall of nozzle |
| 32 | Aperture |
| 34 | Protrusion |
| 36 | Inner Surface of aperture |
| 37 | Outer Edge of aperture |
| 38 | Outer Wall of nozzle |
| 40 | Guide Protrusion |
| 42 | Plug |
| 44 | Outer Surface of plug |
| 46 | Annular Gap |
| 48 | Inner Surface of nozzle |
| 49 | Venting System |
| 50 | Longitudinal Recess |
| 52 | Inner Surfaces of recess |
| 54 | Lower Diameter of inner wall |
| 56 | Upper Diameter of inner wall |
| 58 | Lower Diameter of outer wall |
| 60 | Upper Diameter of outer wall |
| 61 | Lower portion of outer wall |
| 62 | Stop |
| 64 | Lower Surface of stop |

-continued

| Ref. No. | Description |
|---|---|
| 66 | Upper Surface of stop |
| 67 | Outer Surface of stop |
| 68 | Lip of plug |
| 70 | Complementary Surface within body portion |
| 110 | Cap |
| 112 | Body |
| 114 | Support Member |
| 116 | Nozzle |
| 118 | Plug |
| 120 | Chamber |
| 210 | Nozzle |
| 212 | Interior Bore |
| 214 | Outer Wall |
| 216 | Venting System |
| 218 | Longitudinal Recess |
| 220 | Inner Surface of recess |
| 222 | Guide Protrusion |
| 224 | Stop |
| 310 | Nozzle |
| 312 | Outer Wall |
| 314 | Longitudinal Recess |
| 316 | Inner Surface of recess |
| 410 | Cap |
| 412 | Body |
| 414 | Nozzle |
| 416 | Leg Portion |
| 417 | Lower Portion of nozzle |
| 418 | Outer Wall of nozzle |
| 419 | Longitudinal Recess |
| 420 | Seal |
| 422 | Annular Wall |
| 424 | Attachment Extension |
| 426 | Loop |
| 428 | Interior Bore |
| 430 | Foot Member |
| 432 | Stop |
| 434 | Distal End of leg portion |
| 435 | Projection on foot member |
| 436 | Upper Surface of stop |
| 438 | Complementary surfaces |
| 440 | Inner Wall of nozzle |
| 442 | Annular Ring |
| 444 | Attachment Slots |
| 446 | Attachment Projections |
| 448 | Plug |
| 450 | Support Member |
| 452 | Aperture |
| 454 | Inner Surface of aperture |
| 456 | Central Support Member |
| 458 | Lower Portion of aperture |
| 460 | Panel on central support member |
| 462 | Upper Portion of central support member |
| 464 | Outer Surface of plug |
| 466 | Shoulder |
| 468 | Inner Lip of nozzle |
| 470 | Air Separation Baffle |
| 472 | Opening |

What is claimed is:

1. A cap, comprising:

a body including an annular wall, a cylindrical aperture disposed in a protrusion generally opposite the annular wall, and a cylindrical plug rigidly attached within the aperture and defining an annular gap between an outer surface of the plug and an inner surface of the aperture; and a hollow nozzle configured to fit within the annular gap and including:

an inner wall having a lower diameter exceeding a diameter of the plug and an upper diameter tapering to become smaller than the diameter of the plug, an outer wall having a lower diameter smaller than a diameter of the inner surface of the aperture and an upper diameter tapering to become larger than the diameter of the inner surface of the aperture, the outer wall further including at least one guide protrusion having a diameter approximately equal to the diameter of the inner surface of the aperture and configured to hold the nozzle in a stable orientation with respect to the aperture, and at least one longitudinal recess formed in the outer wall and configured to allow selective passage of air;

wherein the nozzle is movable within the annular gap between a retracted position in which fluid cannot pass between the outer surface of the plug and an inner surface of the nozzle due to a fluid tight seal formed between the upper diameter of the inner wall and the plug, and an extended position in which the fluid can pass between the outer surface of the plug and the inner surface of the nozzle; and wherein the longitudinal recess terminates proximate to the upper diameter of the outer wall and is thus configured to allow the air to flow through the recess when the nozzle is in the extended position, and is contained within the aperture and is thus configured to prevent the air from flowing through the recess when the nozzle is in the retracted position.

2. The cap of claim 1, wherein the nozzle includes a stop extending outward from a lower portion of the outer wall of the nozzle, the stop including a lower surface configured to abut a complementary lip of the plug when the nozzle is in the retracted position and thus to prevent further movement of the nozzle into the aperture, and an upper surface configured to abut a complementary surface within the body portion when the nozzle is in the extended position and thus to prevent further movement of the nozzle out of the aperture.

3. The cap of claim 1, wherein the recess defines inner surfaces formed from a low surface energy material configured to inhibit water from flowing through the recess due to capillary action.

4. The cap of claim 3, wherein the low surface energy material is selected from a set consisting of silicone and polypropylene.

5. The cap of claim 1, wherein the recess defines a cross sectional area between 0.1 square millimeters and 0.5 square millimeters.

6. The cap of claim 1, wherein the nozzle includes a plurality of longitudinal recesses formed in the outer wall of the nozzle and configured to allow the to flow when the nozzle is in the extended position.

7. The cap of claim 6, wherein the plurality of longitudinal recesses define a total cross sectional area between 3 square millimeters and 15 square millimeters.

8. A cap, comprising:

a body including an annular wall, an elongated cylindrical aperture disposed generally opposite the annular wall, and a cylindrical plug rigidly attached within the aperture and defining an annular gap between an outer surface of the plug and an inner surface of the aperture; and a hollow nozzle configured to fit within the annular gap and including an inner wall and an outer wall having at least one longitudinal recess formed therein;

wherein the nozzle is movable within the annular gap between a retracted position in which fluid cannot pass between the outer surface of the plug and an inner surface of the nozzle due to a fluid tight seal formed between the inner wall and the plug, and an extended position in which the fluid can pass between the outer surface of the plug and the inner surface of the nozzle; and wherein the longitudinal recess is configured to allow air to flow through the recess when the nozzle is in the extended position, and to prevent the air from flowing through the recess when the nozzle is in the retracted position.

9. The cap of claim 8, wherein the recess defines inner surfaces formed from a low surface energy material configured to inhibit water from flowing through the recess due to capillary action.

10. The cap of claim 9, wherein the low surface energy material is selected from a set consisting of silicone and polypropylene.

11. The cap of claim 8, wherein the recess defines a cross sectional area between 0.1 square millimeters and 0.5 square millimeters.

12. The cap of claim 8, wherein the nozzle includes a plurality of longitudinal recesses formed in the outer wall of the nozzle and configured to allow the air to flow when the nozzle is in the extended position.

13. The cap of claim 12, wherein the plurality of longitudinal recesses define a total cross sectional area between 3 square millimeters and 15 square millimeters.

* * * * *